US011766623B1

(12) United States Patent
Chen

(10) Patent No.: US 11,766,623 B1
(45) Date of Patent: Sep. 26, 2023

(54) FRISBEE

(71) Applicant: Huasheng Chen, Zhangzhou (CN)

(72) Inventor: Huasheng Chen, Zhangzhou (CN)

(73) Assignee: Huasheng Chen, Zhangzhou (CN)

( * ) Notice: Subject to any disclaimer, the term of this patent is extended or adjusted under 35 U.S.C. 154(b) by 0 days.

(21) Appl. No.: 17/992,487

(22) Filed: Nov. 22, 2022

(51) Int. Cl.

| | |
|---|---|
| ***A63H 33/18*** | (2006.01) |
| ***A63H 29/22*** | (2006.01) |
| ***A63H 33/26*** | (2006.01) |
| ***A63H 27/00*** | (2006.01) |

(52) U.S. Cl.
CPC ..... *A63H 33/18* (2013.01); *A63H 29/22* (2013.01); *A63H 33/26* (2013.01); *A63H 27/12* (2013.01)

(58) Field of Classification Search
CPC ..... A63H 33/18; A63H 27/12
USPC ..... 446/36, 37, 46, 47, 48, 57, 58
See application file for complete search history.

(56) References Cited

U.S. PATENT DOCUMENTS

| | | | | |
|---|---|---|---|---|
| 2,938,298 | A * | 5/1960 | Apostolescu | A63H 27/12 446/37 |
| 3,394,906 | A * | 7/1968 | Rogers | B64C 39/001 446/37 |
| 5,474,482 | A * | 12/1995 | Davidson | A63H 27/12 446/41 |
| 6,843,699 | B2 * | 1/2005 | Davis | A63H 33/18 446/37 |
| 7,255,623 | B2 * | 8/2007 | Davis | A63H 30/04 446/37 |
| 7,273,195 | B1 * | 9/2007 | Golliher | A63H 27/12 244/17.11 |
| 8,113,905 | B2 * | 2/2012 | Davis | A63H 27/12 446/46 |
| 8,348,712 | B2 * | 1/2013 | De La Torre | A63H 33/22 446/175 |
| 9,067,667 | B2 * | 6/2015 | Yan | B64C 27/10 |
| 9,873,064 | B1 * | 1/2018 | Adkins | A63H 33/185 |
| 10,112,694 | B2 * | 10/2018 | Yan | G05D 1/0011 |
| 10,245,522 | B1 * | 4/2019 | Williams | A63H 33/001 |
| 11,019,947 | B2 * | 6/2021 | Shendelman | A63H 33/18 |
| 2005/0082421 | A1 * | 4/2005 | Perlo | B64C 27/20 244/12.2 |
| 2007/0049159 | A1 * | 3/2007 | Kulis | A63H 17/28 446/438 |

(Continued)

FOREIGN PATENT DOCUMENTS

| | | | |
|---|---|---|---|
| CN | 108094252 | A | 6/2018 |
| CN | 111841041 | A | 10/2020 |
| CN | 214260675 | U | 9/2021 |

*Primary Examiner* — Joseph B Baldori
(74) *Attorney, Agent, or Firm* — Nitin Kaushik

(57) ABSTRACT

A frisbee comprises a rotating shaft and a surface cover, a first fan blade, a second fan blade, a fan blade gear, a third fan blade and a bottom case, and the first fan blade comprises a first casing, the second fan blade comprises a second casing, and the rotating shaft passes through the first casing, the second casing, the fan blade gear and the third fan blade; a cavity is arranged with an electric motor and a main board, the output end of the electric motor is arranged with a motor gear meshing, the main board is arranged on the first casing, and a switch button is arranged on the first casing, and the switch button is connected with the main board, and the cover is arranged with a first through hole corresponding to the switch button. The structure of the frisbee can be simplified.

9 Claims, 14 Drawing Sheets

(56) References Cited

U.S. PATENT DOCUMENTS

| | | | | |
|---|---|---|---|---|
| 2012/0099983 | A1* | 4/2012 | Medlock | B64C 27/20 415/208.1 |
| 2012/0302125 | A1* | 11/2012 | Choh | A63H 27/12 446/46 |
| 2013/0068877 | A1* | 3/2013 | Choi | B64C 39/024 244/17.19 |
| 2016/0101368 | A1* | 4/2016 | Rehkemper | A63H 27/12 446/58 |
| 2018/0200641 | A1* | 7/2018 | Warren | A63H 33/18 |
| 2020/0238188 | A1* | 7/2020 | Liao | A63H 27/00 |
| 2021/0114730 | A1* | 4/2021 | Macdonald | F16C 19/10 |
| 2021/0370192 | A1* | 12/2021 | Matloff | G05D 1/106 |
| 2022/0314137 | A1* | 10/2022 | Liao | A63H 27/00 |
| 2023/0060888 | A1* | 3/2023 | Yan | B64C 39/024 |

* cited by examiner

100

FRISBEE

TECHNICAL FIELD

The present disclosure relates to the technical filed of aircraft toy, and in particular to a frisbee.

BACKGROUND

At present, there are only toy airplanes in the existing toy flying products, and there are no other flying toy products. The functions and styles of toy airplanes are different, and although traditional toy airplanes are more playable, their structures are relatively complicated.

SUMMARY

The present disclosure aims to solve at least one of the above technical problems, by providing a frisbee, which can simplify the structure of flying toy products.

The present disclosure provides a frisbee on the one hand, comprising: a rotating shaft and a surface cover, a first fan blade, a second fan blade, a fan blade gear, a third fan blade and a bottom case arranged in sequence, and the first fan blade comprises a first casing and a plurality of first blades arranged on the outer wall of the first casing, the second fan blade comprises a second casing and a plurality of second blades arranged on the outer wall of the second casing, and the two ends of the rotating shaft are respectively rotatably connected to the surface cover and the bottom case, and the rotating shaft passes through the first casing, the second casing, the fan blade gear and the third fan blade in turn, and the fan blade gear and the third fan blade rotate synchronously around the rotating shaft;

a cavity formed by the first casing and the second casing is arranged with an electric motor and a main board, an output end of the electric motor protrudes from the second casing, and the output end of the electric motor is arranged with a motor gear meshing with the fan blade gear, the main board is arranged on the first casing, and a switch button is arranged on the first casing, and the switch button is connected with the main board, and the main board is connected to the electric motor, and the cover is arranged with a first through hole corresponding to the switch button;

when the switch button is pressed through the first through hole, the electric motor rotates, drives the motor gear to rotate, drives the fan blade gear to rotate, drives the third fan blade to rotate, and makes the frisbee fly up.

Wherein, the surface cover and the bottom case both have a hollow grid structure, and the surface cover and the bottom case enclose to form a cavity.

Wherein the fan blade gear comprises a cylindrical base and a plurality of third blades connected to the side wall of the cylindrical base, the cylindrical base is arranged with a non-circular through hole, and one side of the fan blade gear is arranged with a non-circular post corresponding to the non-circular through hole, the non-circular post is inserted into the non-circular through hole, a second through hole is opened on the non-circular post, and the rotating shaft passes through the first casing, the second casing and the second through hole in turn.

wherein the frisbee also comprises a light board, the light board is arranged with a light strip, and one side of the second fan blade is arranged with a plurality of protrusions, and the plurality of protrusions are inserted into the light board to make the light board detachably fixed on the second fan blade.

Wherein a shaft sleeve is arranged between the first casing and the second casing, and the rotating shaft passes through the shaft sleeve.

Wherein an inductive sensor is arranged on the first casing, and a battery is arranged on the first casing, and the battery is used to supply power to the frisbee.

Wherein the surface cover and the bottom case are arranged with installation positions, and the surface cover and the bottom case are connected by screws passing through the installation positions.

Wherein the face cover is arranged with a plurality of positioning columns, the bottom shell is arranged with a plurality of positioning grooves corresponding to the plurality of positioning columns, the tops of the plurality of positioning columns and the bottom of the positioning grooves are arranged with magnets, the plurality of positioning columns are inserted into the corresponding positioning grooves and adsorption connected by magnet, so as to connect the surface cover and the bottom case.

Wherein the surface cover is arranged with a first limiting column and a second limiting column arranged on the first limiting column, and the bottom case is arranged with a first limiting groove and a second limiting groove connected to each other, the width of the second limiting groove is the same as the diameter of the first limiting groove, the width of the first limiting groove is the same as the diameter of the second limiting groove, and the diameter of the first limiting groove is smaller than the diameter of the second limiting column, after the second limiting column passes through the first limiting groove, the surface cover is rotated relative to the bottom case, so that the first limiting column enters the first limiting groove, and the first limiting groove limits the axial movement of the second limiting column so as to connect the surface cover and the bottom case.

Wherein springs are arranged on the surface cover and the bottom case.

The frisbee comprises a rotating shaft and a surface cover, a first fan blade, a second fan blade, a fan blade gear, a third fan blade and a bottom case arranged in sequence, and the first fan blade comprises a first casing and a plurality of first blades arranged on the outer wall of the first casing, the second fan blade comprises a second casing and a plurality of second blades arranged on the outer wall of the second casing, and the two ends of the rotating shaft are respectively rotatably connected to the surface cover and the bottom case, and the rotating shaft passes through the first casing, the second casing, the fan blade gear and the third fan blade in turn, and the fan blade gear and the third fan blade rotate synchronously around the rotating shaft; a cavity formed by the first casing and the second casing is arranged with an electric motor and a main board, an output end of the electric motor protrudes from the second casing, and the output end of the electric motor is arranged with a motor gear meshing with the fan blade gear, the main board is arranged on the first casing, and a switch button is arranged on the first casing, and the switch button is connected with the main board, and the main board is connected to the electric motor, and the cover is arranged with a first through hole corresponding to the switch button; when the switch button is pressed through the first through hole, the electric motor rotates, drives the motor gear to rotate, drives the fan blade gear to rotate, drives the third fan blade to rotate, and makes the frisbee fly up. The structure of the frisbee can be simplified.

DETAILED DESCRIPTION

Figure 1:
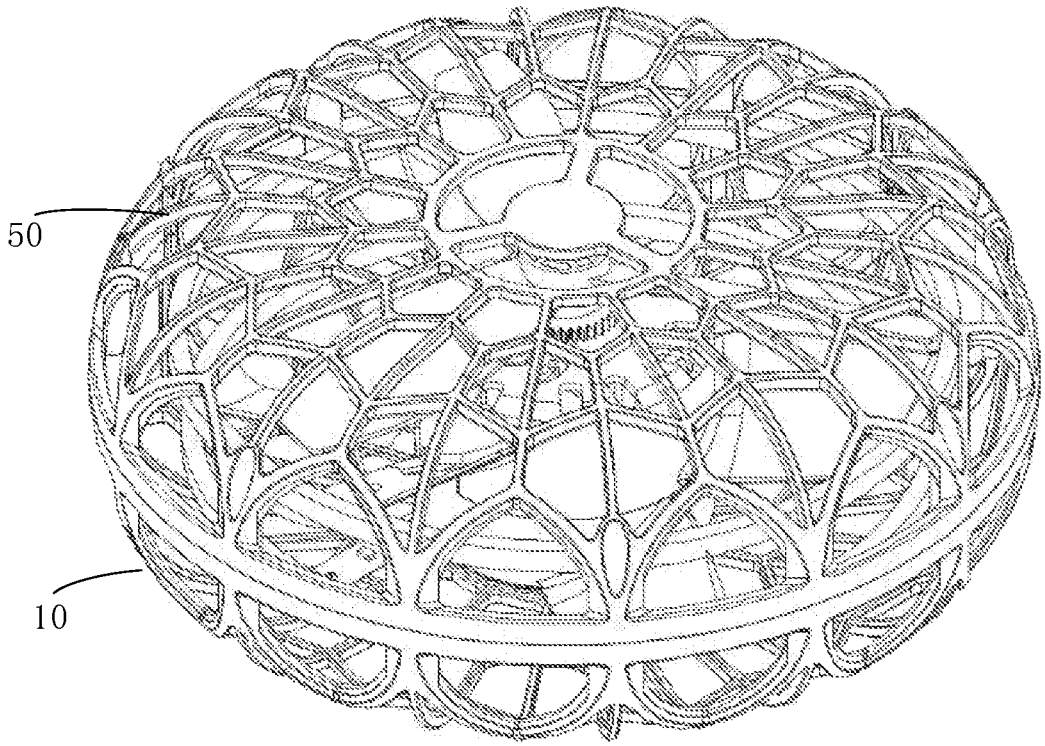
FIG. 1 is an overall structure schematic diagram of the frisbee according to an embodiment of the present disclosure.

The following will clearly and completely describe the technical solutions in the embodiments of the disclosure with reference to the drawings in the embodiments of the disclosure. Apparently, the described embodiments are only some of the embodiments of the disclosure, not all of them. Based on the embodiments in this disclosure, all other embodiments obtained by those skilled in the art without making creative efforts belong to the scope of protection of this disclosure.

In the description of the present disclosure, it should be understood that the terms "center", "longitudinal", "transverse", "length", "width", "thickness", "upper", "lower", "front", "The orientation or positional relationship indicated by "rear", "left", "right", "vertical", "horizontal", "top", "bottom", "inner" and "outer" are based on the orientation or positional relationship shown in the drawings only for the convenience of describing the present disclosure and simplifying the description, but does not indicate or imply that the device or element referred to must have a specific orientation, be constructed and operated in a specific orientation, and therefore should not be construed as limiting the present disclosure. In addition, the terms "first" and "second" are used for descriptive purposes only, and cannot be interpreted as indicating or implying relative importance or implicitly specifying the quantity of indicated technical features. Thus, features defined as "first" and "second" may explicitly or implicitly include one or more features. In the description of the present disclosure, "plurality" means two or more, unless otherwise specifically defined.

In this disclosure, the word "exemplary" is used to mean "serving as an example, illustration or illustration". Any embodiment described in this application as "exemplary" is not necessarily to be construed as preferred or advantageous over other embodiments. The following description is given to enable any person skilled in the art to make and use the disclosure. In the following description, details are set forth for purposes of explanation. It should be understood that one of ordinary skill in the art would recognize that the present disclosure may be practiced without these specific details. In other instances, well-known structures and processes are not described in detail to avoid obscuring the description of the present disclosure with unnecessary detail. Thus, the present disclosure is not intended to be limited to the embodiments shown, but is to be accorded the widest scope consistent with the principles and features disclosed in this disclosure.

Figure 2:
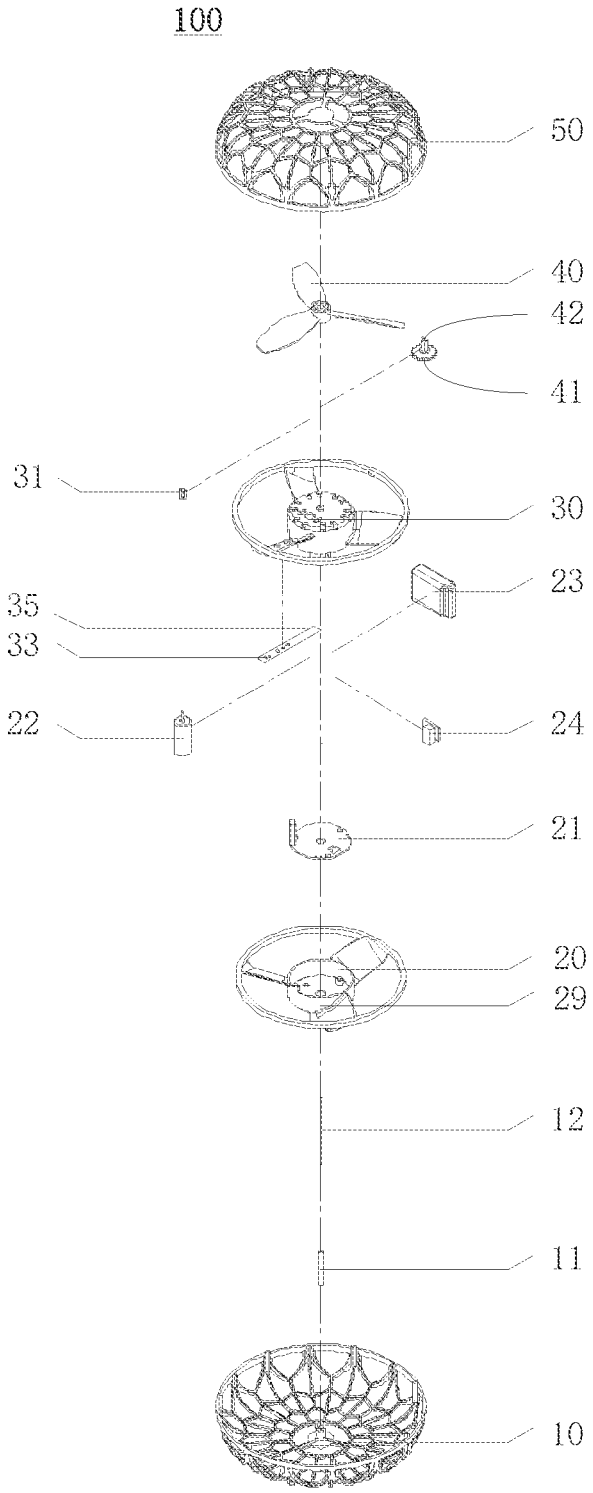
FIG. 2 is an explosion structure schematic diagram of the frisbee according to an embodiment of the present disclosure.
Figure 3:
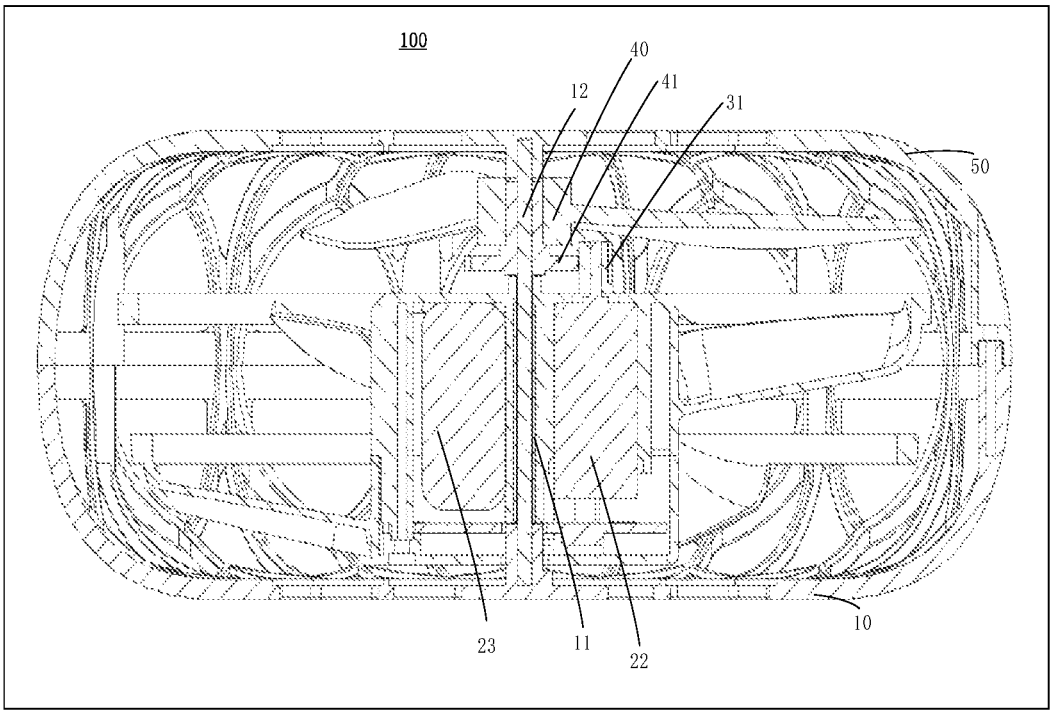
FIG. 3 is a cross-sectional structure schematic diagram of the frisbee according to an embodiment of the present disclosure.
Figure 4:
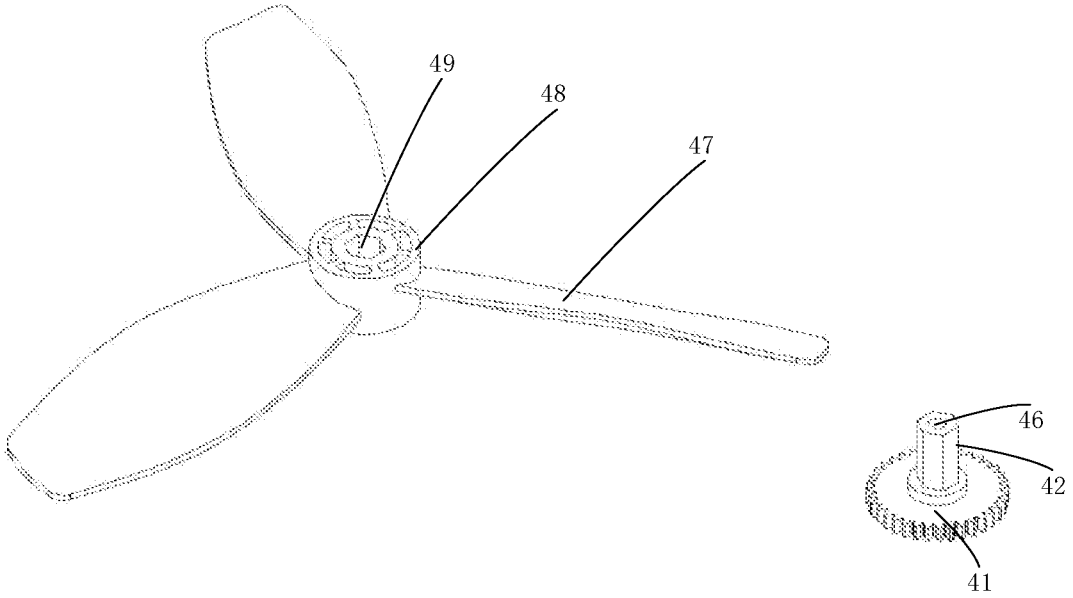
FIG. 4 is a structural schematic diagram of the third blade and the blade gear in an embodiment of the frisbee according to the present disclosure.
Figure 5:
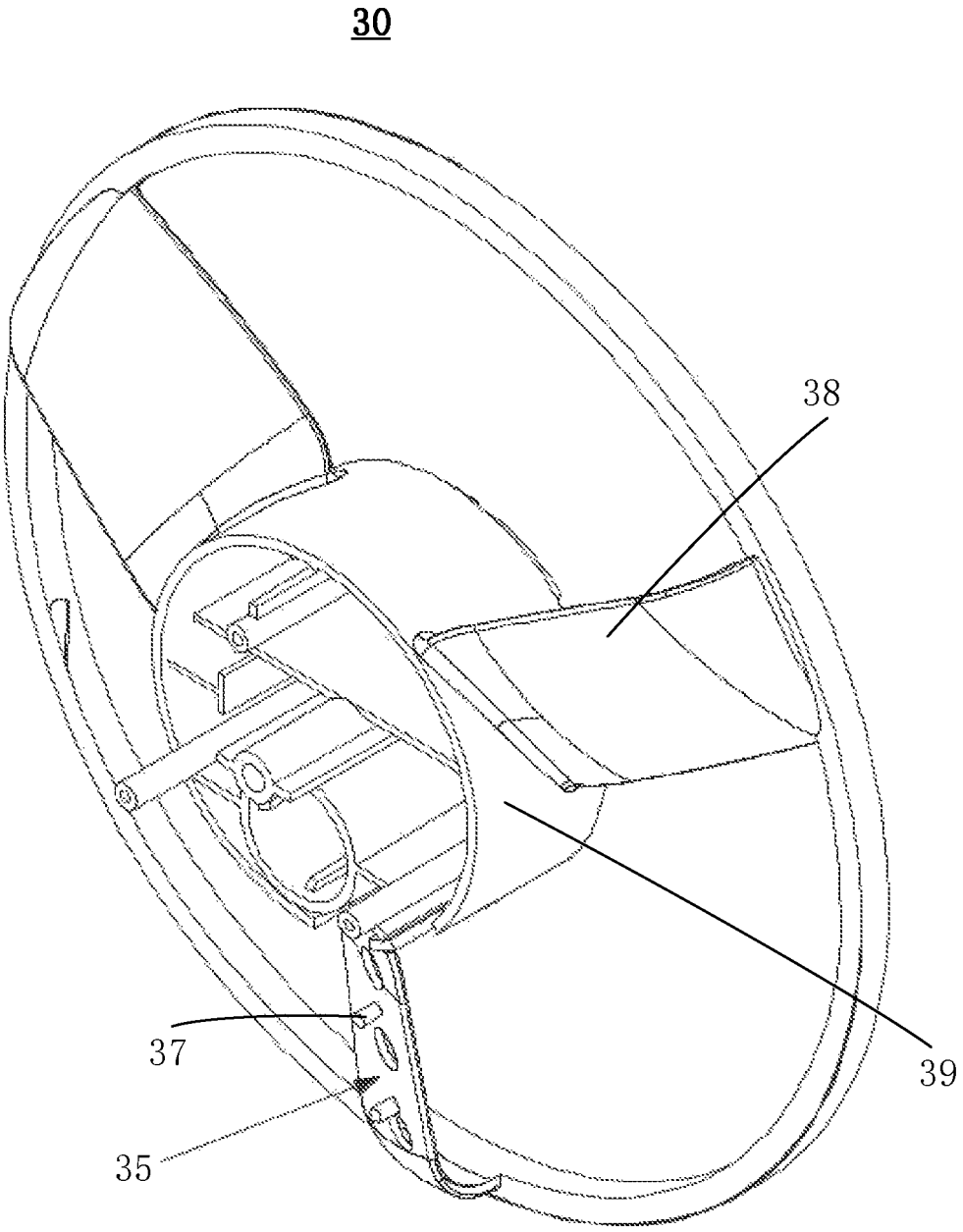
FIG. 5 is a schematic diagram of the second housing in an embodiment of the frisbee according to the present disclosure.
Figure 6:
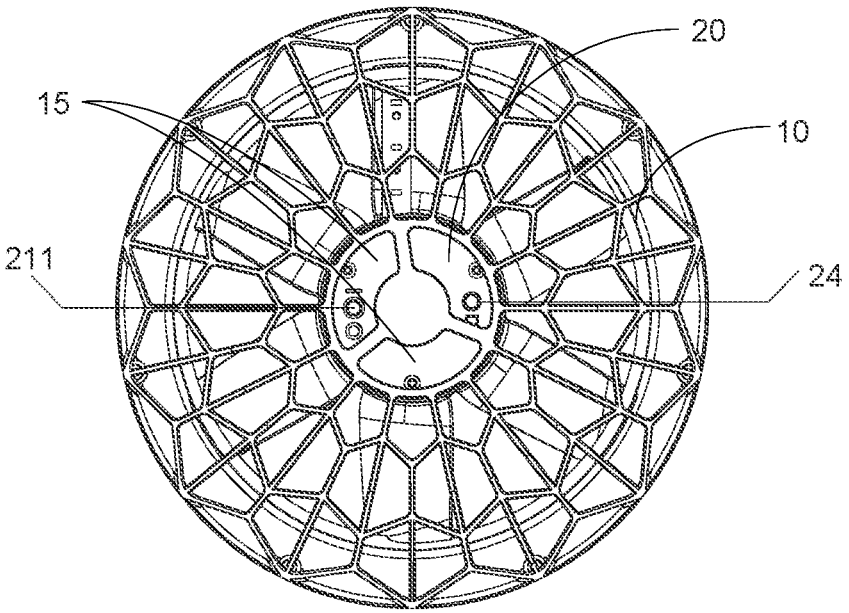
FIG. 6 is a bottom surface structure schematic diagram of the frisbee according to an embodiment of the present disclosure.
Figure 7:
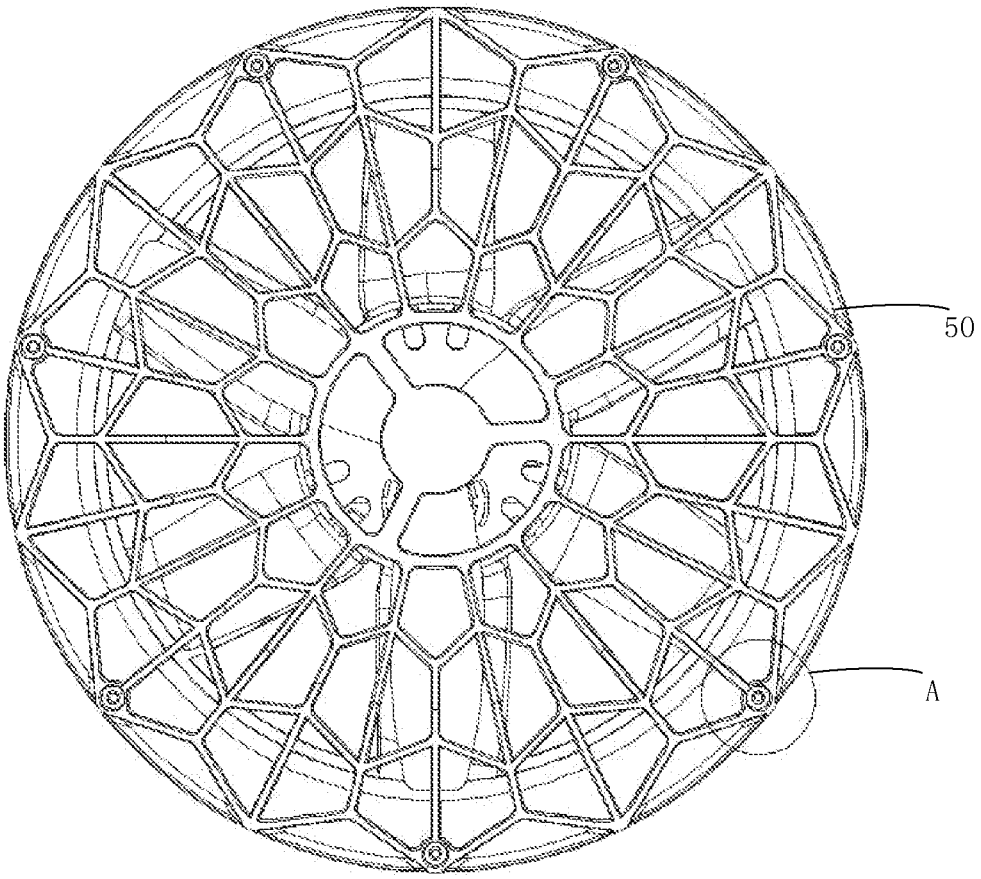
FIG. 7 is a top surface structure schematic diagram of the frisbee according to an embodiment of the present disclosure.
Figure 8:
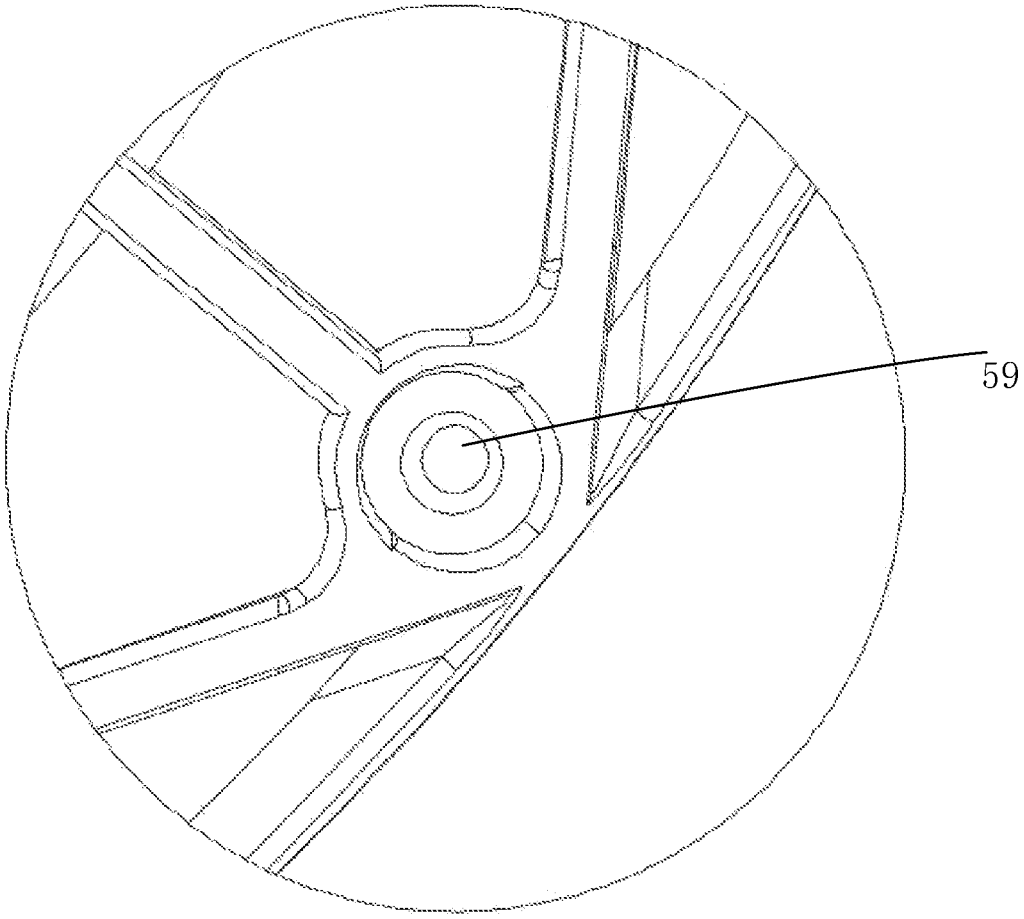
FIG. 8 is a schematic diagram of area A in FIG. 7.
Figure 9:
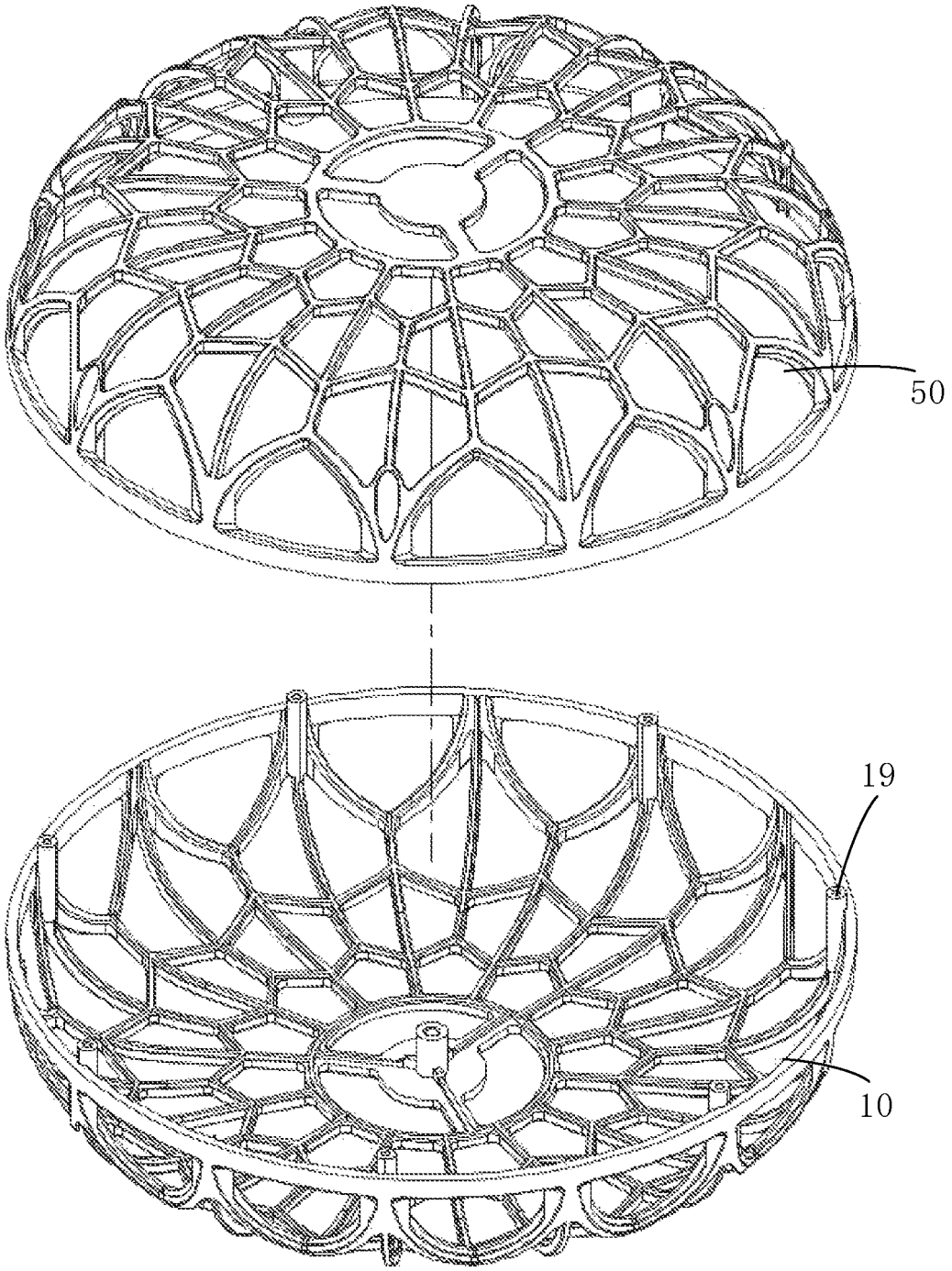
FIG. 9 is a schematic diagram of the surface cover and the bottom case in another embodiment of the frisbee according to the present disclosure.
Figure 10:
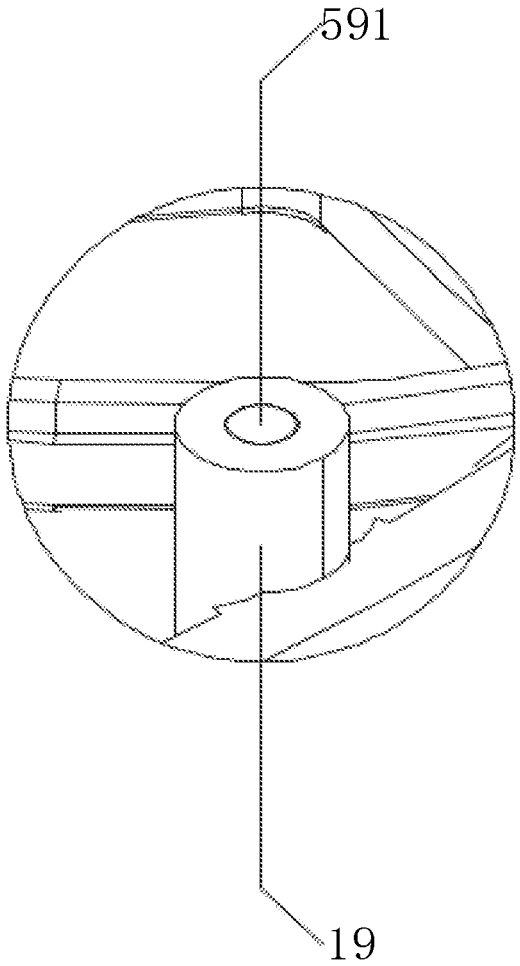
FIG. 10 is a schematic diagram of the positioning column in another embodiment of the frisbee according to the present disclosure.
Figure 11:
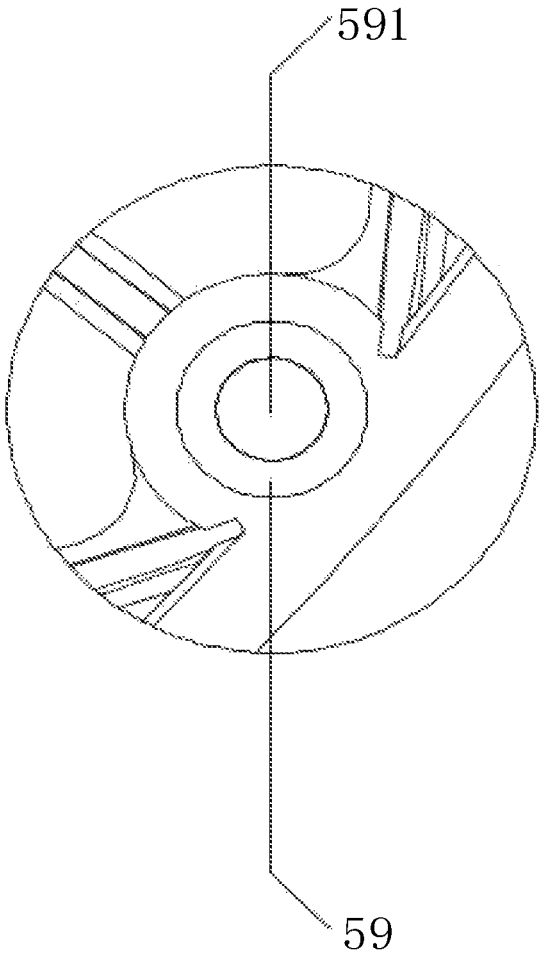
FIG. 11 is a schematic diagram of the positioning groove in another embodiment of the frisbee according to the present disclosure.
Figure 12:
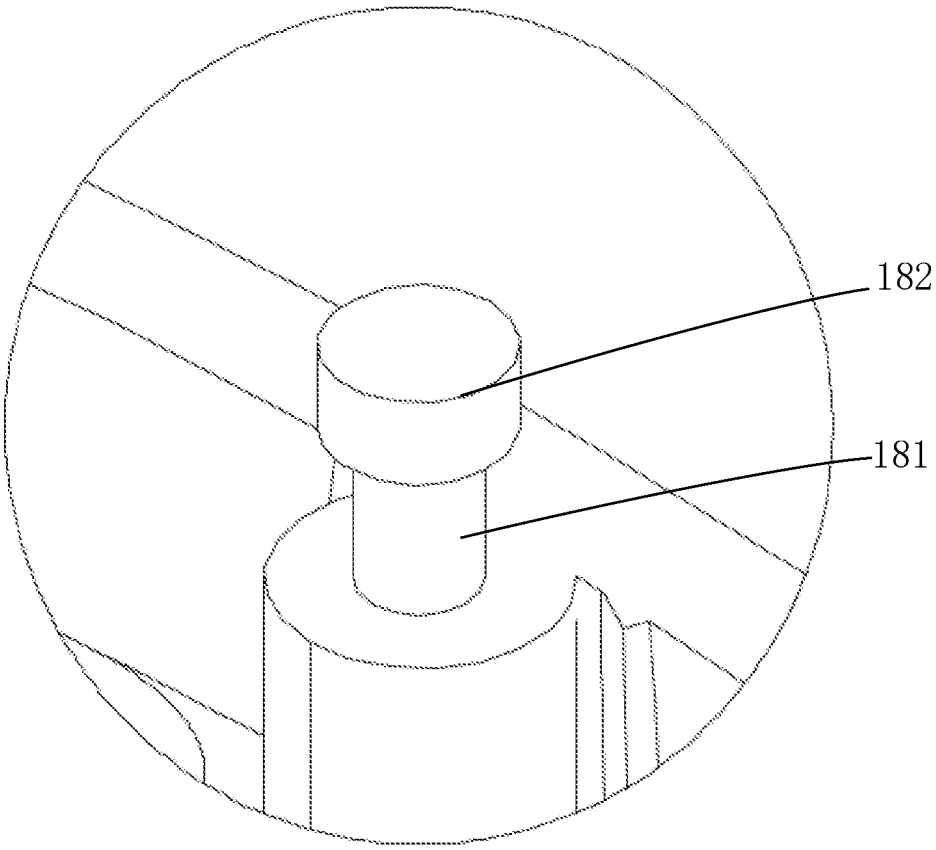
FIG. 12 is a schematic diagram of the first limit post and the second limit post in another embodiment of the frisbee according to the present disclosure.
Figure 13:
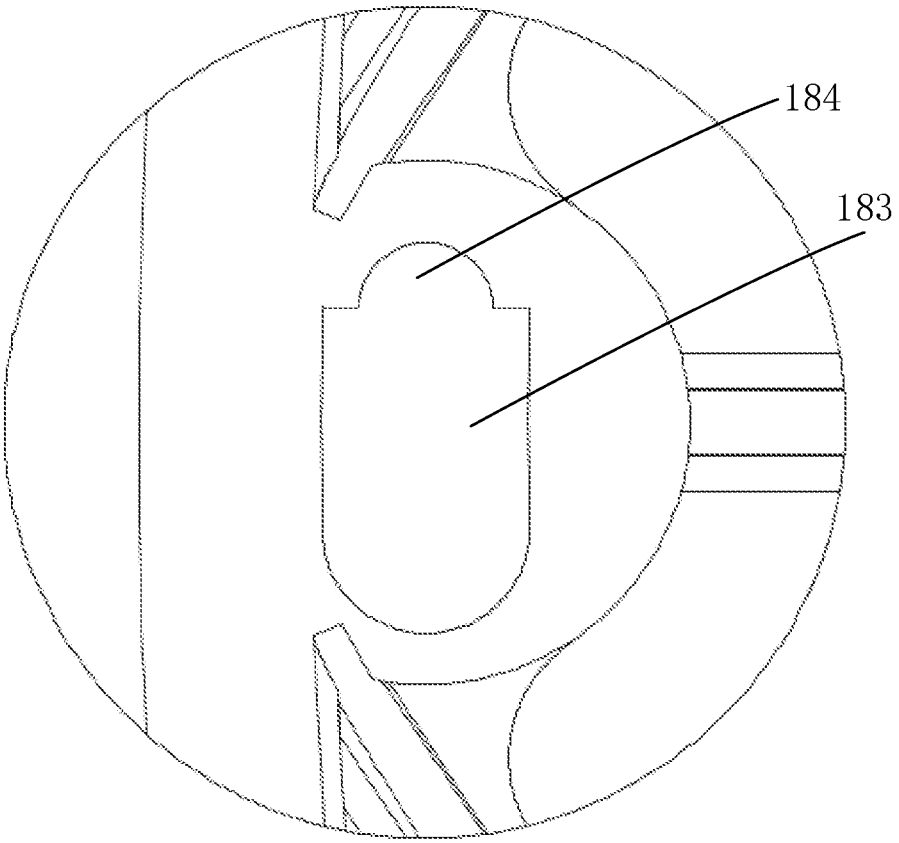
FIG. 13 is a schematic diagram of the first limiting groove and the second limiting groove in another embodiment of the frisbee according to the present disclosure.
Figure 14:
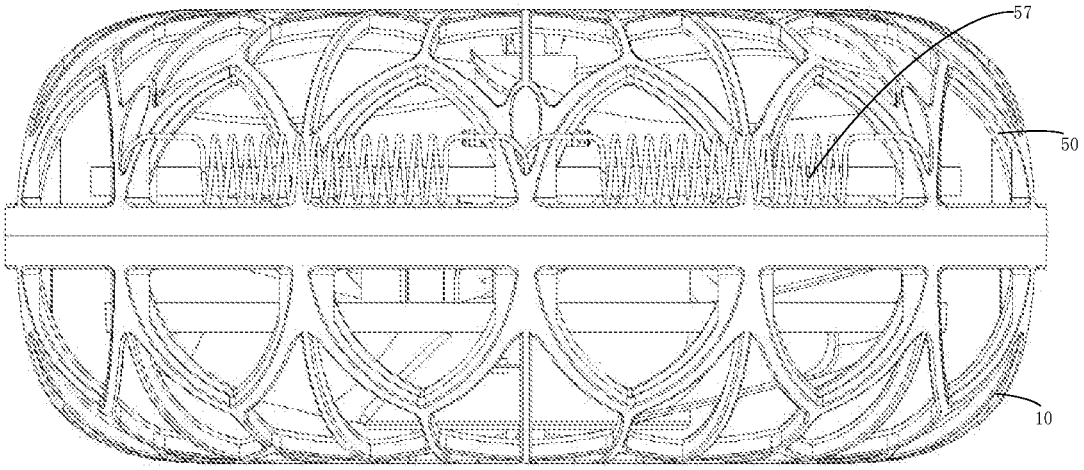
FIG. 14 is a schematic diagram of another embodiment of the frisbee according to the present disclosure.

Referring to FIG. 1-14, FIG. 1 is an overall structure schematic diagram of the frisbee according to an embodiment of the present disclosure. FIG. 2 is an explosion structure schematic diagram of the frisbee according to an embodiment of the present disclosure. FIG. 3 is a cross-sectional structure schematic diagram of the frisbee according to an embodiment of the present disclosure. FIG. 4 is a structural schematic diagram of the third blade and the blade gear in an embodiment of the frisbee according to the present disclosure. FIG. 5 is a schematic diagram of the second housing in an embodiment of the frisbee according to the present disclosure. FIG. 6 is a bottom surface structure schematic diagram of the frisbee according to an embodiment of the present disclosure. FIG. 7 is a top surface structure schematic diagram of the frisbee according to an embodiment of the present disclosure. FIG. 8 is a schematic diagram of area A in FIG. 7. FIG. 9 is a schematic diagram of the surface cover and the bottom case in another embodiment of the frisbee according to the present disclosure. FIG. 10 is a schematic diagram of the positioning column in another embodiment of the frisbee according to the present disclosure. FIG. 11 is a schematic diagram of the positioning groove in another embodiment of the frisbee according to the present disclosure. FIG. 12 is a schematic diagram of the first limit post and the second limit post in another embodiment of the frisbee according to the present disclosure. FIG. 13 is a schematic diagram of the first limiting groove and the second limiting groove in another embodiment of the frisbee according to the present disclosure. FIG. 14 is a schematic diagram of another embodiment of the frisbee according to the present disclosure.

In the embodiment of the present disclosure, the frisbee 100 comprises a rotating shaft 11 and a surface cover 10, a first fan blade 20, a second fan blade 30, a fan blade gear 41, a third fan blade 40 and a bottom case 50 arranged in sequence, and the first fan blade 20 comprises a first casing 29 and a plurality of first blades arranged on the outer wall of the first casing 29, the second fan blade 30 comprises a second casing 39 and a plurality of second blades arranged on the outer wall of the second casing 39, and the two ends of the rotating shaft 11 are respectively rotatably connected to the surface cover 10 and the bottom case 50, and the rotating shaft 11 passes through the first casing 29, the second casing 39, the fan blade gear 41 and the third fan blade 40 in turn, and the fan blade gear 41 and the third fan blade 40 rotate synchronously around the rotating shaft 11.

A cavity formed by the first casing 29 and the second casing 39 is arranged with an electric motor 22 and a main board 21, an output end of the electric motor 22 protrudes from the second casing 39, and the output end of the electric motor 22 is arranged with a motor gear 31 meshing with the fan blade gear 41, the main board 21 is arranged on the first casing 29, and a switch button 211 is arranged on the first casing 29, and the switch button 211 is connected with the main board 21, and the main board 21 is connected to the electric motor 22, and the cover 10 is arranged with a first through hole 15 corresponding to the switch button 211. An inductive sensor 24 is arranged on the first casing 29, and a battery 23 is arranged on the first casing 29, and the battery 23 is used to supply power to the frisbee. The surface cover 10 is arranged with the first through hole 15 for easy access. Therefore, the finger can easily press the switch button 211, and the light emitted by the induction sensor 24 can not be blocked.

When the switch button 211 is pressed through the first through hole 15, the electric motor rotates 22 drives the motor gear 31 to rotate, drives the fan blade gear 41 to rotate, drives the third fan blade 40 to rotate, and makes the frisbee 100 fly up.

In the embodiment of this disclosure, the surface cover 10 and the bottom case 50 both have a hollow grid structure, and the surface cover 10 and the bottom case 50 enclose to form a cavity.

In the embodiment of this disclosure, the fan blade gear 41 comprises a cylindrical base 48 and a plurality of third blades 47 connected to the side wall of the cylindrical base 48, the cylindrical base 48 is arranged with a non-circular through hole 49, and one side of the fan blade gear 41 is arranged with a non-circular post 42 corresponding to the non-circular through hole 49, the non-circular post 42 is inserted into the non-circular through hole 49, a second through hole 46 is opened on the non-circular post 42, and the rotating shaft 11 passes through the first casing 29, the second casing 39 and the second through hole 46 in turn.

In the embodiment of this disclosure, the frisbee 100 also comprises a light board 35, the light board 35 is arranged with a light strip 33, and one side of the second fan blade 30 is arranged with a plurality of protrusions 37, and the plurality of protrusions 37 are inserted into the light board 35 to make the light board 35 detachably fixed on the second fan blade 30.

In the embodiment of this disclosure, a shaft sleeve 11 is arranged between the first casing 29 and the second casing 39, and the rotating shaft 11 passes through the shaft sleeve 11.

In a specific embodiment, referring to FIG. 7 to FIG. 8, the surface cover 10 and the bottom case 50 are arranged with installation positions 59, and the surface cover 10 and the bottom case 50 are connected by screws passing through the installation positions.

In another specific embodiment, referring to FIG. 9 to FIG. 11, the face cover 10 is arranged with a plurality of positioning columns 19, the bottom case 50 is arranged with a plurality of positioning grooves 59 corresponding to the plurality of positioning columns 19, the tops of the plurality of positioning columns 19 and the bottom of the positioning grooves 59 are arranged with magnets 591, the plurality of positioning columns 19 are inserted into the corresponding positioning grooves 59 and adsorption connected by magnet 591, so as to connect the surface cover 10 and the bottom case 50.

In yet another specific embodiment, referring to FIG. 12 to FIG. 13, the surface cover 10 is arranged with a first limiting column 181 and a second limiting column 182 arranged on the first limiting column 181, and the bottom case 50 is arranged with a first limiting groove 183 and a second limiting groove 184 connected to each other, the width of the second limiting groove 184 is the same as the diameter of the first limiting column 181, the width of the first limiting groove 183 is the same as the diameter of the second limiting column 182, and the diameter of the first limiting groove 181 is smaller than the diameter of the second limiting column 182, after the second limiting column 182 passes through the first limiting groove 183, the surface cover 10 is rotated relative to the bottom case 50, so that the first limiting column 181 enters the second limiting groove 184, and the second limiting groove 184 limits the axial movement of the second limiting column 182 so as to connect the surface cover 10 and the bottom case 50.

In the embodiment of this disclosure, springs 57 are arranged on the surface cover 10 and the bottom case 50. The effect of spring 57 is to reduce the damage that collision causes, damping.

In another embodiment, a balance ring is provided between the surface cover 10 and the bottom case 50 to balance the centrifugal force generated by the eccentric load driven by the motor 22 to rotate the third fan 40, thereby ensuring that the frisbee is more stable in flight, it can be understood that the balance ring can be set up as a single layer or a double layer, and a single layer balance ring and a double layer balance ring. The use of the balance ring, especially the structure of the double layer balance ring, can make the suspension of the flying disc more stable, the playability is greatly enhanced.

The frisbee of this application, comprises a rotating shaft and a surface cover, a first fan blade, a second fan blade, a fan blade gear, a third fan blade and a bottom case arranged in sequence, and the first fan blade comprises a first casing and a plurality of first blades arranged on the outer wall of the first casing, the second fan blade comprises a second casing and a plurality of second blades arranged on the outer wall of the second casing, and the two ends of the rotating shaft are respectively rotatably connected to the surface cover and the bottom case, and the rotating shaft passes through the first casing, the second casing, the fan blade gear and the third fan blade in turn, and the fan blade gear and the third fan blade rotate synchronously around the rotating shaft; a cavity formed by the first casing and the second casing is arranged with an electric motor and a main board, an output end of the electric motor protrudes from the second casing, and the output end of the electric motor is arranged with a motor gear meshing with the fan blade gear, the main board is arranged on the first casing, and a switch button is arranged on the first casing, and the switch button is connected with the main board, and the main board is connected to the electric motor, and the cover is arranged with a first through hole corresponding to the switch button; when the switch button is pressed through the first through hole, the electric motor rotates, drives the motor gear to rotate, drives the fan blade gear to rotate, drives the third fan blade to rotate, and makes the frisbee fly up. The structure of the frisbee can be simplified.

The above is only the implementation mode of this disclosure, and does not limit the scope of patents of this disclosure. Any equivalent structure or equivalent process conversion made by using the contents of this disclosure specification and drawings, or directly or indirectly used in other related technical fields, All are equally included in the scope of patent protection of this disclosure.

What is claimed is:

1. A frisbee, comprising:

a rotating shaft and a surface cover, a first fan blade, a second fan blade, a fan blade gear, a third fan blade and a bottom case arranged in sequence, and the first fan blade comprises a first casing and a plurality of first blades arranged on the outer wall of the first casing, the second fan blade comprises a second casing and a plurality of second blades arranged on the outer wall of the second casing, and the two ends of the rotating shaft are respectively rotatably connected to the surface cover and the bottom case, and the rotating shaft passes through the first casing, the second casing, the fan blade gear and the third fan blade in turn, and the fan blade gear and the third fan blade rotate synchronously around the rotating shaft;

a cavity formed by the first casing and the second casing is arranged with an electric motor and a main board, an output end of the electric motor protrudes from the second casing, and the output end of the electric motor is arranged with a motor gear meshing with the fan blade gear, the main board is arranged on the first casing, and a switch button is arranged on the first casing, and the switch button is connected with the main board, and the main board is connected to the electric motor, and the surface cover is arranged with a first through hole corresponding to the switch button;

when the switch button is pressed through the first through hole, the electric motor rotates drives the motor gear to rotate, drives the fan blade gear to rotate, drives the third fan blade to rotate, and makes the frisbee fly up;

wherein the surface cover is arranged with a first limiting column and a second limiting column arranged on the first limiting column, and the bottom case is arranged with a first limiting groove and a second limiting groove connected to each other, the width of the second limiting groove is the same as the diameter of the first limiting column, the width of the first limiting groove is the same as the diameter of the second limiting column, and the diameter of the first limiting column is smaller than the diameter of the second limiting column, after the second limiting column passes through the first limiting groove, the surface cover is rotated relative to the bottom case, so that the first limiting column enters the second limiting groove, and the second limiting groove limits the axial movement of the second limiting column so as to connect the surface cover and the bottom case.

2. The frisbee according to claim 1, wherein the surface cover and the bottom case both have a hollow grid structure, and the surface cover and the bottom case enclose to form a cavity.

3. The frisbee according to claim 2, wherein the fan blade gear is arranged on a cylindrical base and a plurality of third blades are connected to the side wall of the cylindrical base, the cylindrical base is arranged with a non-circular through hole, and one side of the fan blade gear is arranged with a non-circular post corresponding to the non-circular through hole, the non-circular post is inserted into the non-circular through hole, a second through hole is opened on the non-circular post, and the rotating shaft passes through the first casing, the second casing and the second through hole in turn.

4. The frisbee according to claim 3, wherein the frisbee also comprises a light board, the light board is arranged with a light strip, and one side of the second fan blade is arranged with a plurality of protrusions, and the plurality of protrusions are inserted into the light board to make the light board detachably fixed on the second fan blade.

5. The frisbee according to claim 4, wherein a shaft sleeve is arranged between the first casing and the second casing, and the rotating shaft passes through the shaft sleeve.

6. The frisbee according to claim 5, wherein an inductive sensor is arranged on the first casing, and a battery is arranged on the first casing, and the battery is used to supply power to the frisbee.

7. The frisbee according to claim 6, wherein the surface cover and the bottom case are arranged with installation positions, and the surface cover and the bottom case are connected by screws passing through the installation positions.

8. The frisbee according to claim 6, wherein the surface cover is arranged with a plurality of positioning columns, the bottom case is arranged with a plurality of positioning grooves corresponding to the plurality of positioning columns, the tops of the plurality of positioning columns and the bottom of the positioning grooves are arranged with magnets, the plurality of positioning columns are inserted into the corresponding positioning grooves so as to connect the surface cover and the bottom case.

9. The frisbee according to claim 6, wherein springs are arranged on the surface cover and the bottom case.

* * * * *